United States Patent [19]

Schnall et al.

[11] 4,251,155

[45] Feb. 17, 1981

[54] CLEANING ARRANGEMENT IN AN ELECTROPHOTOGRAPHIC COPYING MACHINE

[75] Inventors: Günther Schnall, Eching; Ludwig Müllritter, Munich; Erich Schlick, Unterschleissheim; Hanns Blöchl, Unterhaching; Peter Lischinski, Grünwald, all of Fed. Rep. of Germany

[73] Assignee: AGFA-Gevaert, A.G., Leverkusen, Fed. Rep. of Germany

[21] Appl. No.: 32,494

[22] Filed: Apr. 23, 1979

[30] Foreign Application Priority Data

Apr. 22, 1978 [DE] Fed. Rep. of Germany ... 7812291[U]

[51] Int. Cl.[3] ..... G03G 21/00

[52] U.S. Cl. ..... 355/15; 15/347

[58] Field of Search ..... 355/3 R, 15; 15/306 R, 15/306 A, 347, DIG. 8

[56] References Cited

U.S. PATENT DOCUMENTS

| | | | |
|---|---|---|---|
| 3,410,060 | 11/1968 | Reilly et al. | 355/15 UX |
| 3,483,679 | 12/1969 | Balbierer | 355/15 UX |
| 4,021,113 | 5/1977 | Zindikus et al. | 355/15 |
| 4,140,389 | 2/1979 | Franke et al. | 355/15 |

*Primary Examiner*—Fred L. Braun

*Attorney, Agent, or Firm*—Michael J. Striker

[57] ABSTRACT

The cleaning arrangement of an electrophotographic copying machine scrapes off the machine's copying drum residual toner clinging to the surface of the copying drum subsequent to image transfer, and the residual toner is conveyed generally horizontally into a toner-collection compartment. The toner-collection compartment accommodates a generally rigid but collapsible fold-up cardboard toner-collection container which is thrown away after one use. The throw-away toner-collection container, when in collapsed condition, is flat so that a sizable number of such throw-away containers can be kept on hand without requiring an inconvenient amount of storage space. The bottom of the container projects forwards beyond the top, in the direction opposite to the generally horizontal direction of toner conveyance into the collection compartment, and is furthermore provided with an upright standing rim, the forwardly projecting bottom ledge and such rim preventing inadvertent spilling of toner from the collection container as the latter is in the process of being removed from the cleaning arrangement by the machine attendant, i.e., before the container can be tilted upwards to a position in which its inlet opening faces upwards.

4 Claims, 3 Drawing Figures

CLEANING ARRANGEMENT IN AN ELECTROPHOTOGRAPHIC COPYING MACHINE

BACKGROUND OF THE INVENTION

The present invention concerns cleaning arrangements in electrostatic copying machines operative for removing residual toner from an intermediate image carrier, e.g., the surface of a copying drum, to which such residual toner clings, such arrangements typically including means for loosening the residual toner from the intermediate image carrier and means for transporting the thusly removed toner to a residual-toner storage chamber. For example, the cleaning arrangement may be provided with a rotating bar of polygonal cross section located at the inlet into the residual-toner storage chamber, serving to transport the removed residual toner into the storage chamber, and with a wipe-off element located between the rotating bar and a wall of the storage chamber and serving to close off the latter while simultaneously being resiliently pressed against the rotating bar and serving to wipe off residual toner clinging to the rotating bar.

A cleaning arrangement of this type is disclosed, for example in Federal Republic of Germany published patent application DE-OS 26 13 235. In the system of that patent, the residual toner is conveyed into a container which, as soon as it becomes full, must be removed from the machine, emptied, and then once more mounted in operative position within the copying machine. The emptying of the toner-filled container is a rather unpleasant task for the attendant of such a machine, because the attendant can so easily become soiled by the toner in the container. Also, the wastepaper basket, or the like, into which the toner-filled container is emptied necessarily becomes dirtied by toner in a manner difficult for subsequent cleaning, unless the attendant goes to the trouble of some special countermeasure each time the container is emptied, such as emptying the container into a plastic bag and then closing off such a bag before dumping it into the wastepaper basket, and so forth.

SUMMARY OF THE INVENTION

It is a main object of the invention to facilitate the task of removing and disposing of such residual toner, to an extent that the attendant responsible for this task be spared so considerable a risk of becoming soiled, and likewise with a greatly reduced possibility of spilled toner dirtying the wastepaper basket, or the like, into which the toner is to go.

In accordance with the preferred concept of the present invention, the toner-collection compartment of the cleaning arrangement accommodates a removable throw-away container, preferably made of simple cardboard, which, as soon as it becomes full, can readily be removed from the machine and placed into a wastepaper basket, or the like, without the dumping of toner to which the machine attendant has hitherto been forced to resort in the prior art, and accordingly without the comcomitant possibilities of the attendant becoming soiled by toner or of the wastepaper basket becoming extensively soiled with toner in a manner posing substantial work to cleaning personnel responsible for the condition of the wastepaper basket. Thereafter, another such throw-away container is inserted into the toner-collection compartment of the machine.

According to a particularly preferred concept of the invention, the throw-away container is provided in the form of a fold-up box, i.e., a box which can be supplied and stored in flattened-out or unfolded condition and then assembled or folded up into operative condition when needed for use. This makes it particularly simple to keep on hand a relatively large number of such throw-away toner containers, without requiring any substantial amount of storage space. With the concept of the present invention utilized, it is particularly important that the throw-away containers employed be of such form that the unavoidable need to keep a fair number of them on hand not become a nuisance with respect to the amount of storage space they then require.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
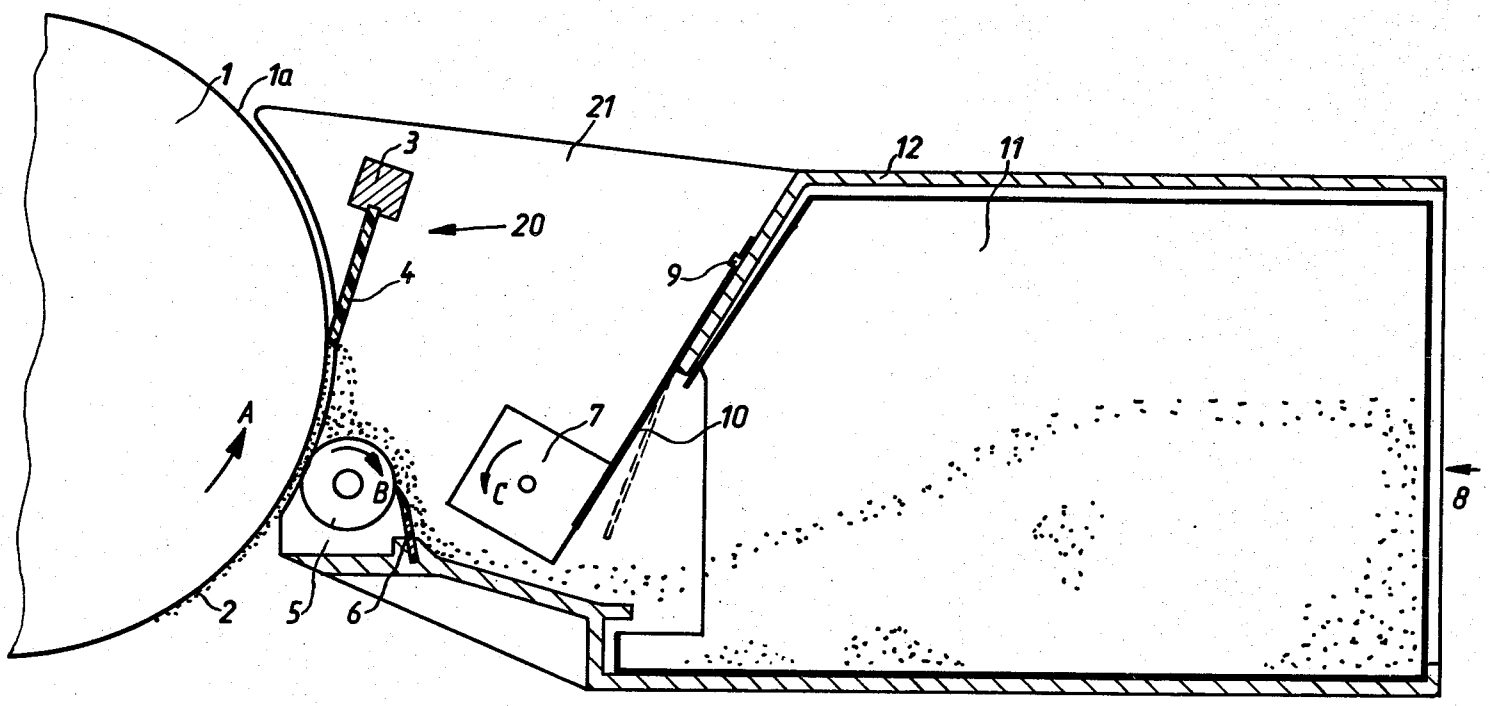
FIG. 1 is a section taken through a somewhat schematically illustrated cleaning arrangement, internal to an electrophotographic copying machine, of the type here involved and provided with a throw-away toner-collection container in accordance with the present invention.

In FIG. 1, numeral 1 denotes the copying drum of an electrophotographic copying machine, the drum 1 rotating in the direction of arrow A and having a photoconductive peripheral surface 1*a*. After a toner image produced on surface 1*a* has been transferred, by non-illustrated means, onto non-illustrated copy stock, residual toner 2 still clinging to peripheral surface 1*a* is removed therefrom by means of a cleaning arrangement, denoted in toto by numeral 20 and mounted by means of a holding element 3 on a wall 21 of the housing of the machine. In particular, holding element 3 mounts a doctor blade 4 which is pressed into riding engagement on the peripheral surface 1*a* of drum 1 and scrapes clinging residual toner 2 off the drum. The toner thusly scraped off drum 1 falls downwards onto a conveyor roller 5 located beneath doctor blade 4. The conveyor roller 5 is mounted on the housing of the machine and is rotated in the direction of arrow B by non-illustrated drive means. The residual toner which falls onto the peripheral surface of conveyor roller 5 is removed therefrom by a further doctor blade 6, which likewise is pressed into riding engagement on the peripheral surface of roller 5, and the toner is conveyed rightwards, towards a rotating bar 7 of polygonal cross section having longitudinal edges extending in the direction of the bar's rotation axis, the bar rotating in the direction of arrow C. The longitudinal edges of polygonal bar 7 dip into accumulating toner and push such toner rightwards into a collection compartment 11. A flexible doctor-blade or wiper element 10 has one or more apertures or grooves 9 which are force-fit over complementary projections of the wall 12 of the toner-collection compartment 11, so that the element 10 be thereby mounted in operative position, or the element 10 can be otherwise mounted. The flexible doctor-blade element 10 resiliently bears against the peripheral surface of rotating polygonal bar 7 and serves to wipe or scrape off residual toner clinging to the surface of bar 7, and additionally serves to close off the left or inlet end of the toner-collection compartment.

The wall of the housing 12 of toner-collection compartment 11 which faces towards the copying drum 1 is accessible from the exterior of the machine to the machine attendant and is provided with a transversely extending inlet opening so located that the rotating polygonal bar 7 efficiently convey residual toner through this inlet opening into the interior of the collection compartment. Collection compartment 11 accommodates a throw-away container 8 which has a configuration complementary to that of the compartment 11 itself, so as to be well supported and stabilized within the interior of the housing 12 of compartment 11. Throw-away container 8 can be pushed into collection compartment 11 through and end of housing 12.

Figure 2:
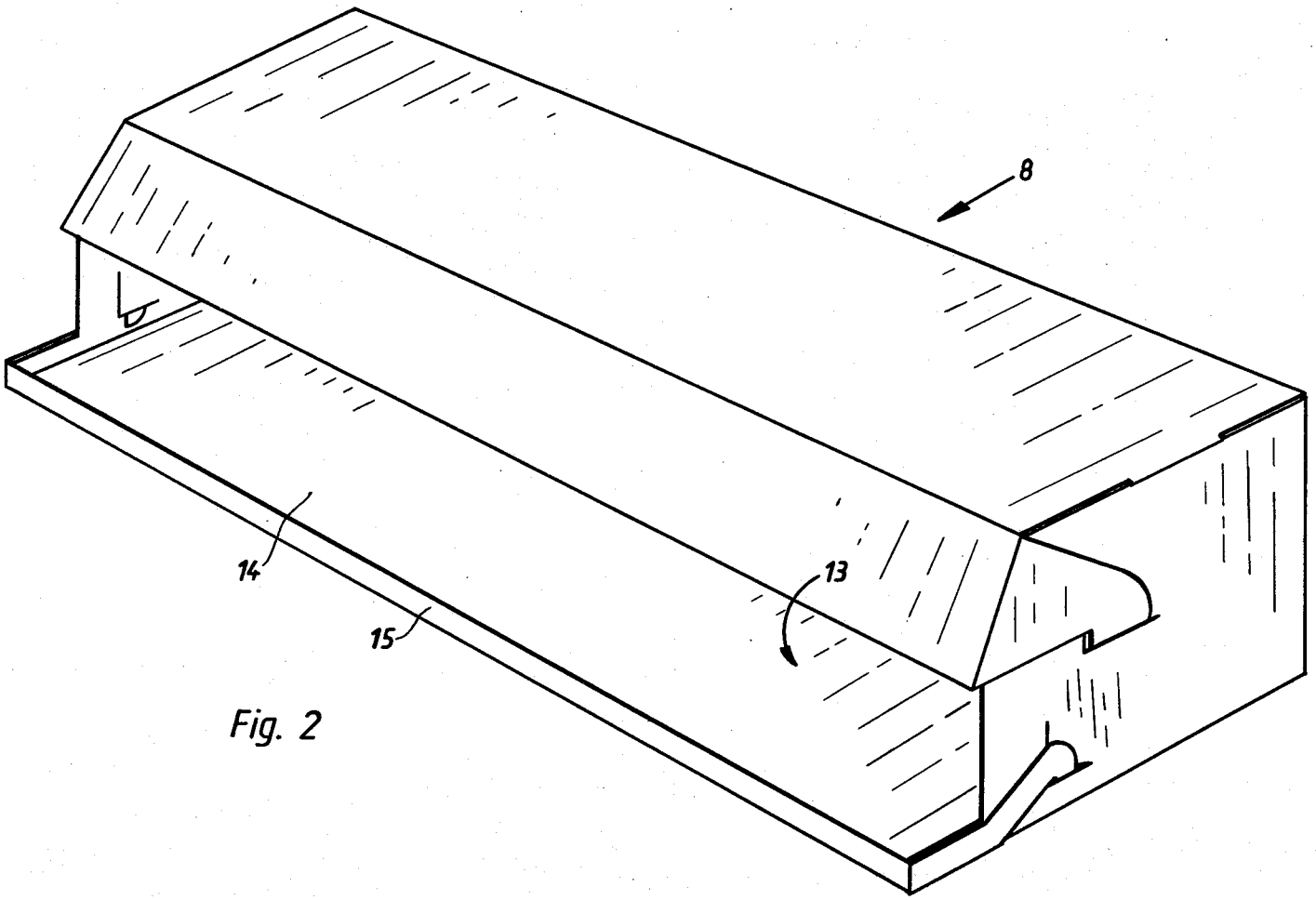
FIG. 2 is a perspective view of the throw-away toner-collection container itself.
Figure 3:
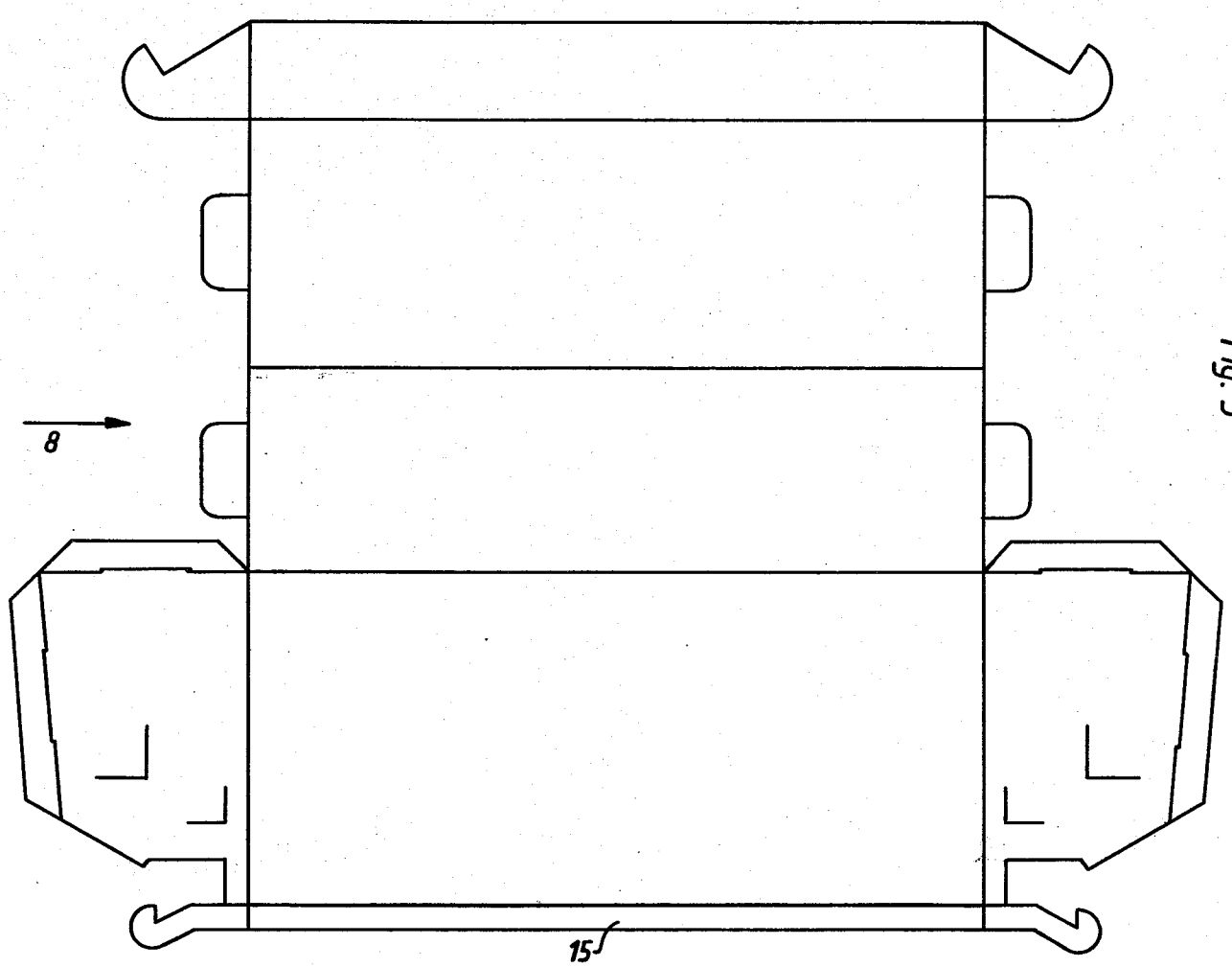
FIG. 3 shows the toner-collection container of FIG. 2 in unfolded-flat condition, i.e., the condition in which it can be stored prior to use in the copying machine.

The construction of the throw-away container itself, here preferably provided as a fold-up cardboard container, is best shown in the perspective view of FIG. 2 and in the unfolded or developed view of FIG. 3. A relatively large number of these fold-up toner-collection containers can be conveniently stored in flat form such as shown in FIG. 3, without requiring any sizable storage space, and then when actually needed be quickly folded up into the operative condition depicted in FIG. 2.

The throw-away container 8 is provided with a transversely extending inlet opening 13 for incoming toner, and its bottom 14 projects forwardly beyond the inlet opening 13 per se, in order to form a projecting ledge of sizable dimension in the toner-conveyance direction, which serves to prevent toner from spilling out of the interior of the cassette as the attendant is in the process of removing the throw-away container 8 from the machine, i.e., before the container 8 can be rotated through 90° into a position in which its inlet opening 13 is located at its top. Additionally, the forward edges of the bottom 14 of the throw-away container 8 are rimmed in by an edge wall 15, further serving to prevent the spilling out of toner as the attendant is removing the container 8 from the machine.

It will be understood that each of the elements described above, or two or more together, may also find a useful application in other types of construction differing from the types described above.

While the invention has been illustrated and described as embodied in a cleaning arrangement of the type identified above and exhibiting generally horizontal conveyance of residual toner into the toner-collection compartment of the cleaning arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In an electrostatic copying machine having an intermediate-image carrier, a cleaning arrangement comprising means for removing residual toner from the intermediate-image carrier; a housing including a compartment having an inlet spaced from said removing means and a wall portion projecting from a lower end of said inlet towards said removing means and carrier, so that residual toner removed from the carrier drops onto said wall portion and accumulates thereon; means for pushing accumulating toner through said inlet into said compartment; and a throw-away tray formed from an originally flat foldable sheet-material blank which is erectable to form the tray shape, said tray being removably received in said compartment and having an open side located at (said) inlet so that toner pushed through said inlet enters the tray via said open side thereof and can subsequently be discarded with the tray when the same is filled.

2. A cleaning arrangement as defined in claim 1, wherein said tray is of cardboard.

3. A cleaning arrangement as defined in claim 1, said tray having a wall, a portion of which projects outwardly beyond said open side in direction towards said removing means and constitutes a ledge preventing the spillage of collected toner from the tray as the tray is being removed from the compartment.

4. A cleaning arrangement as defined in claim 3, said ledge having an upstanding rim to further prevent said toner spillage.

* * * * *